US007878864B2

(12) United States Patent
Wang et al.

(10) Patent No.: US 7,878,864 B2
(45) Date of Patent: Feb. 1, 2011

(54) AUDIO JACK HAVING A CONTACT WITH TWO SECTIONS SEPARATED WITH EACH OTHER

(75) Inventors: Chen-Xi Wang, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/622,448

(22) Filed: Nov. 20, 2009

(65) Prior Publication Data

US 2010/0130043 A1 May 27, 2010

(30) Foreign Application Priority Data

Nov. 21, 2008 (CN) ..... 2008 2 0302874

(51) Int. Cl.
*H01R 24/04* (2006.01)

(52) U.S. Cl. ..... 439/668

(58) Field of Classification Search ..... 439/668, 439/669, 675, 83
See application file for complete search history.

(56) References Cited

U.S. PATENT DOCUMENTS 6,220,898 B1 * 4/2001 Wu ..... 439/668
6,923,687 B2 8/2005 Wang
7,361,062 B2 * 4/2008 Long et al. ..... 439/668
7,591,685 B2 * 9/2009 Zhu et al. ..... 439/668
7,726,990 B2 * 6/2010 Wang et al. ..... 439/188
2002/0052148 A1 * 5/2002 Nagata ..... 439/668
2002/0052149 A1 * 5/2002 Suzuki et al. ..... 439/668

* cited by examiner

*Primary Examiner*—Jean F Duverne
(74) *Attorney, Agent, or Firm*—Wei Te Chung; Andrew C. Cheng; Ming Chieh Chang

(57) ABSTRACT

An audio jack (1) includes an insulative housing (2) defining an insertion opening (213), and a plurality of contacts (3) retained in the insulative housing (2); each contact (3) has a contact portion (313, 3212) extending into the insertion opening (213) and a tail portion (311, 3221) for connecting with a circuit board; at least a contact (32) comprises a mating section (321) for contacting with a corresponding audio plug (8) and a transmission section (322) separated with the mating section (321) for connecting with the circuit board which the mating section (321) does not connect; at least a contact portion (3212) is arranged on the mating section (321) to electrically connect with the transmission section (322) when the audio plug (8) is fully inserted into the insertion opening (213).

14 Claims, 7 Drawing Sheets

AUDIO JACK HAVING A CONTACT WITH TWO SECTIONS SEPARATED WITH EACH OTHER

BACKGROUND OF THE INVENTION

1. Field of the Invention

The present invention relates to an audio jack, and more particularly to an audio jack having a contact with two sections separated with each other.

2. Description of Related Art

Audio jack is used in audio device, such as computer, mobile phone, DVD, MP3 et al. to connect with a corresponding audio plug for transmitting audio signals to consumers. Such an audio jack includes an insulative housing and a plurality of contacts retained in the insulative housing. The insulative housing defines an insertion port for receiving the corresponding audio plug. The contacts comprise a left channel contact retained in a left side of the insulative housing and a right channel contact retained in a right side of the insulative housing. The left and right channel contacts each has a soldering portion soldered to a circuit board and a contact portion extending into the insertion port to contact with the audio plug. When the audio plug is inserted into the insertion port, the audio jack electrically connects with the contact portions to transmit audio signals with the circuit board.

The contact portions is elastic and cantileveredly received in the insertion port for stably contacting with the audio plug. In an insertion process of the audio plug, the audio plug contacts the contact portions at a front side thereof; when the audio plug is continually inserted into the insertion port, the contact portions are resisted sidewardly by the audio jack for contacting with the audio plug stably. However, in above insertion process, the contact portion will transmit signals to consumers as the audio plug contacts with the contact portions, of course, noise is produced when the audio plug rubs with the contact portions before the audio plug is fully inserted into the insertion port, and is transmitted to consumers at the same time.

Hence, an audio jack is desired to overcome the disadvantage of the prior art.

BRIEF SUMMARY OF THE INVENTION

According to one aspect of the present invention, an audio jack comprises: an insulative housing defining an insertion opening; and a plurality of contacts retained in the insulative housing, each contact having a contact portion extending into the insertion opening and a tail portion for connecting with a circuit board; wherein at least a contact comprises a mating section for contacting with a corresponding audio plug and a transmission section separated with the mating section for connecting with the circuit board which the mating section does not connect, at least a contact portion is arranged on the mating section to electrically connect with the transmission section when the audio plug is fully inserted into the insertion opening.

According to another aspect of the present invention, a contact attached to an audio jack, comprises: a mating section having a first position portion retained in the audio jack, a contact portion extending from the first position for contacting with an audio plug, and a first connection portion connecting with the contact portion; and a transmission section having a second position portion attached to the audio jack, a second connection portion extending from the second position portion and a soldering portion extending downwardly from the second position portion for connecting with a circuit board; wherein the mating section is separated from the transmission section, and the mating section can electrically connect with the circuit board via the first connection portion contacts with the second connection when the plug is fully inserted into the audio jack.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
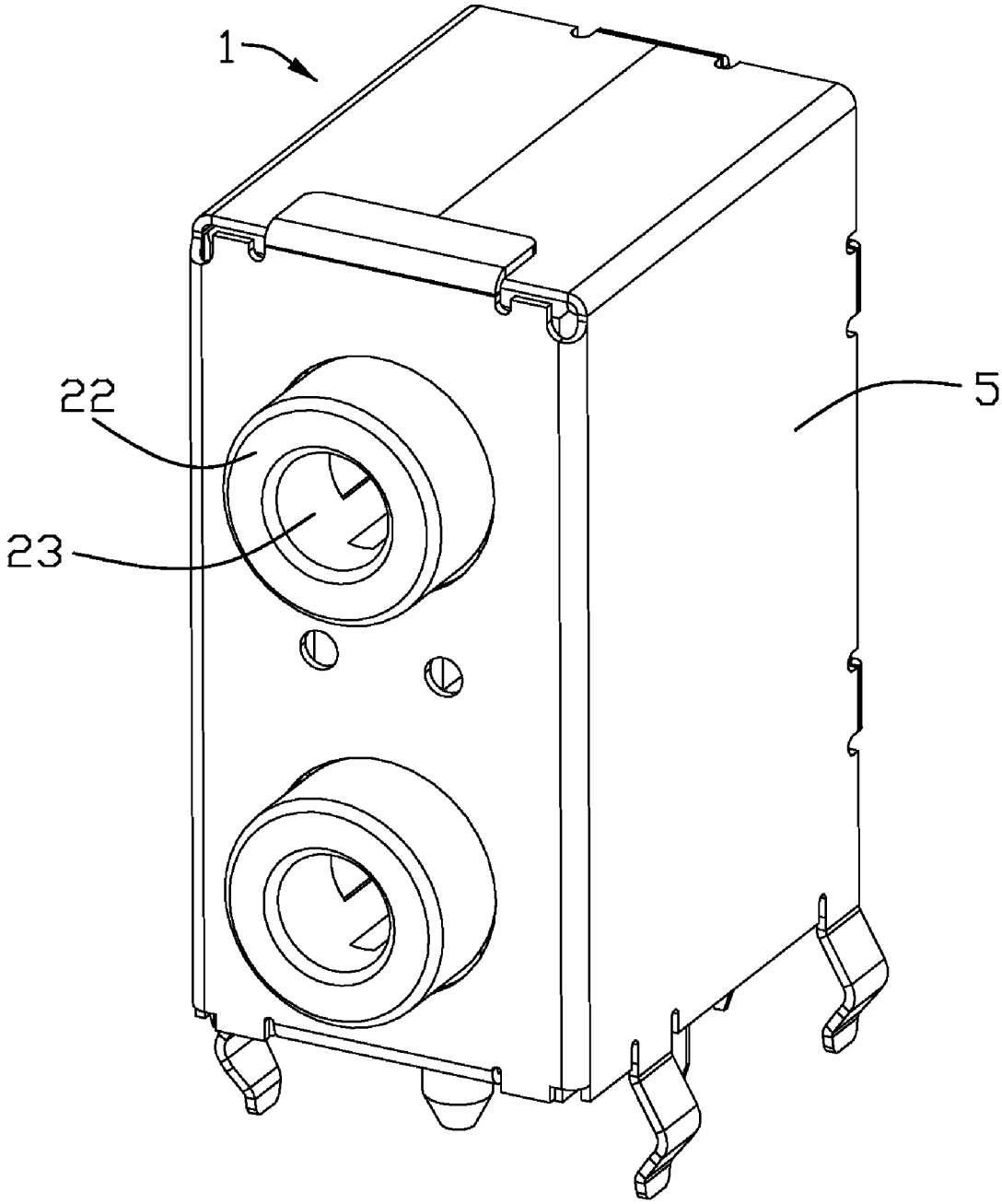
FIG. 1 is a perspective view of an audio jack according to the present invention.
Figure 2:
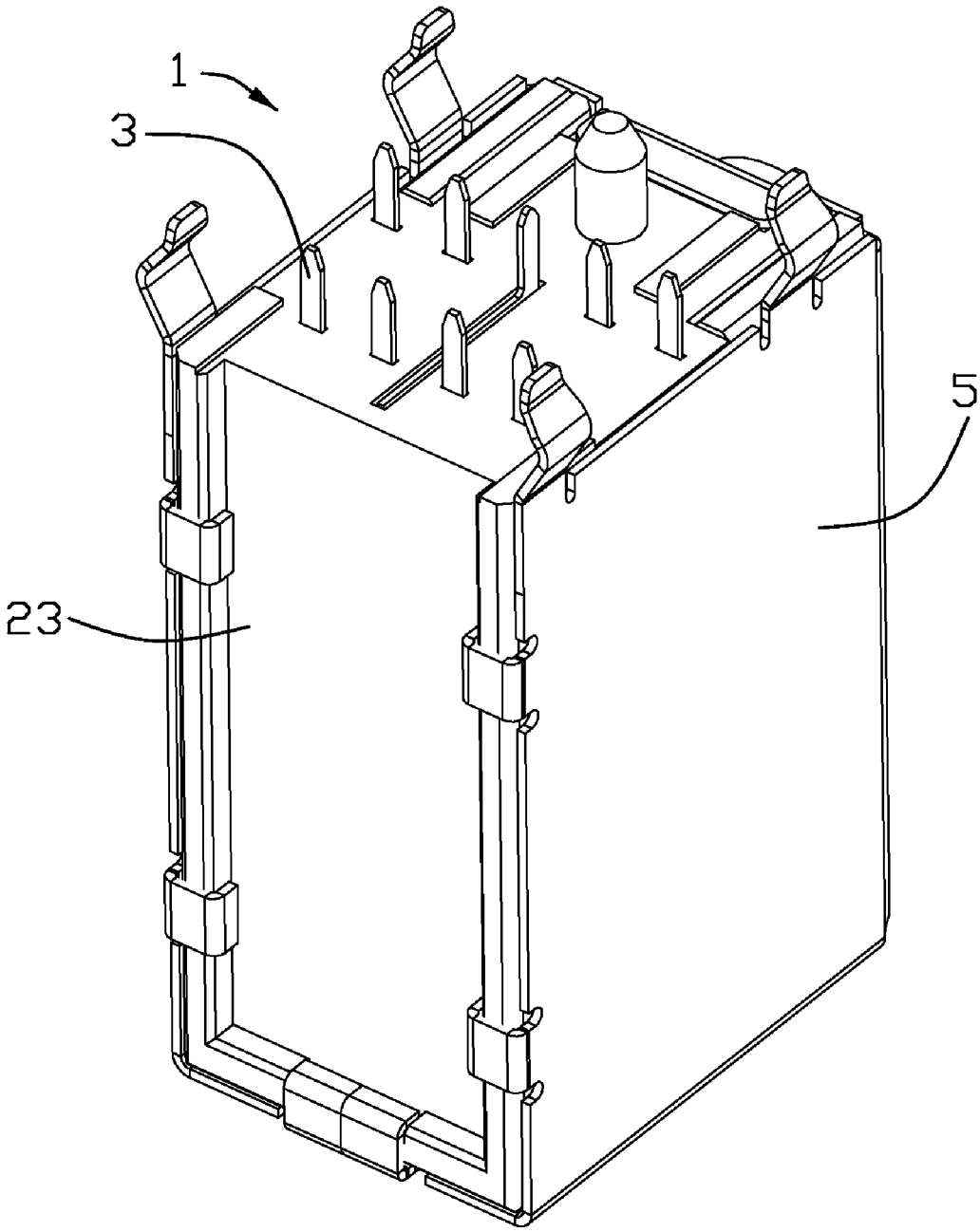
FIG. 2 is a view similar to FIG. 1, while taken from another aspect.
Figure 3:
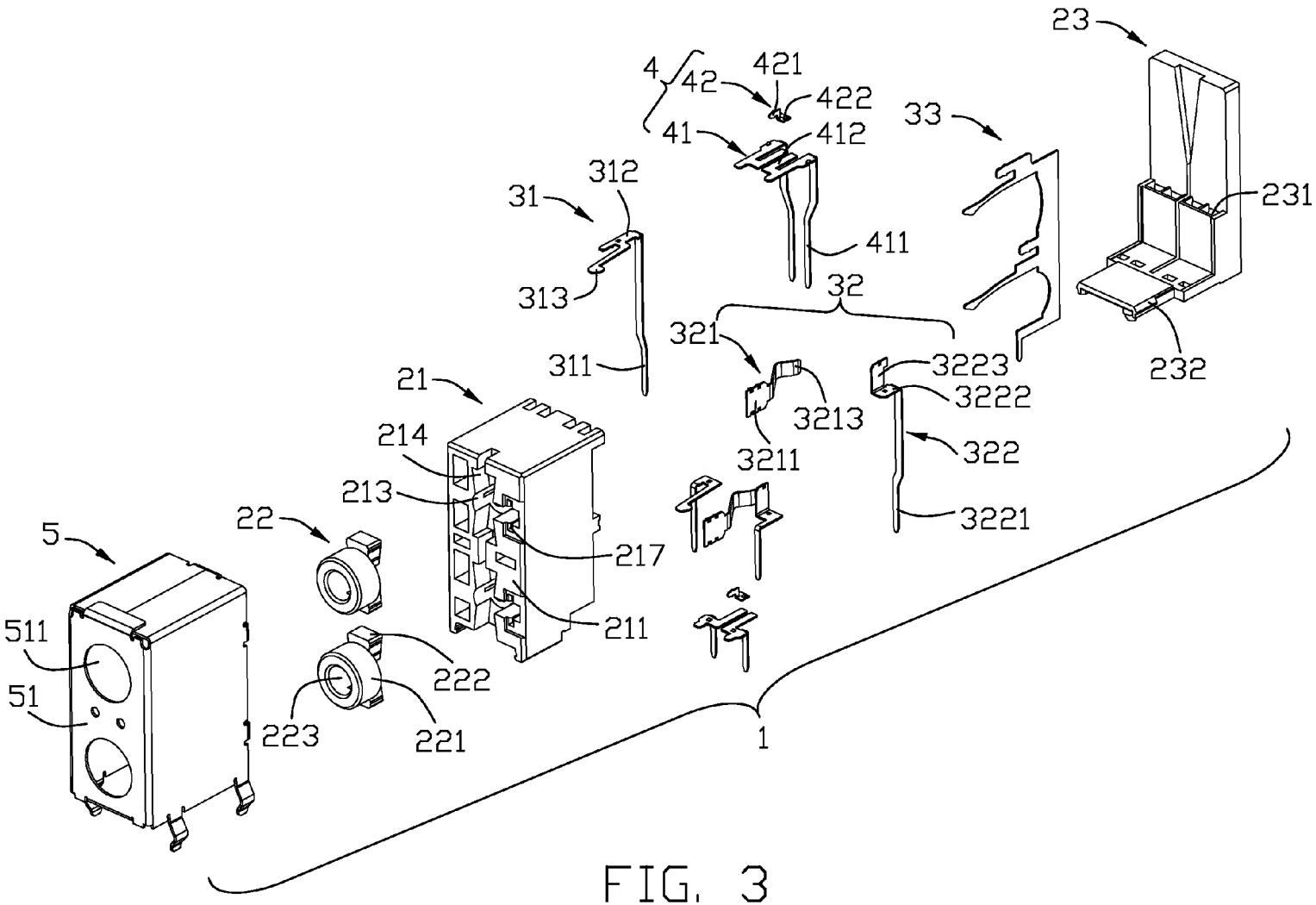
FIG. 3 is an exploded perspective view of the audio jack shown in FIG. 1.
Figure 4:
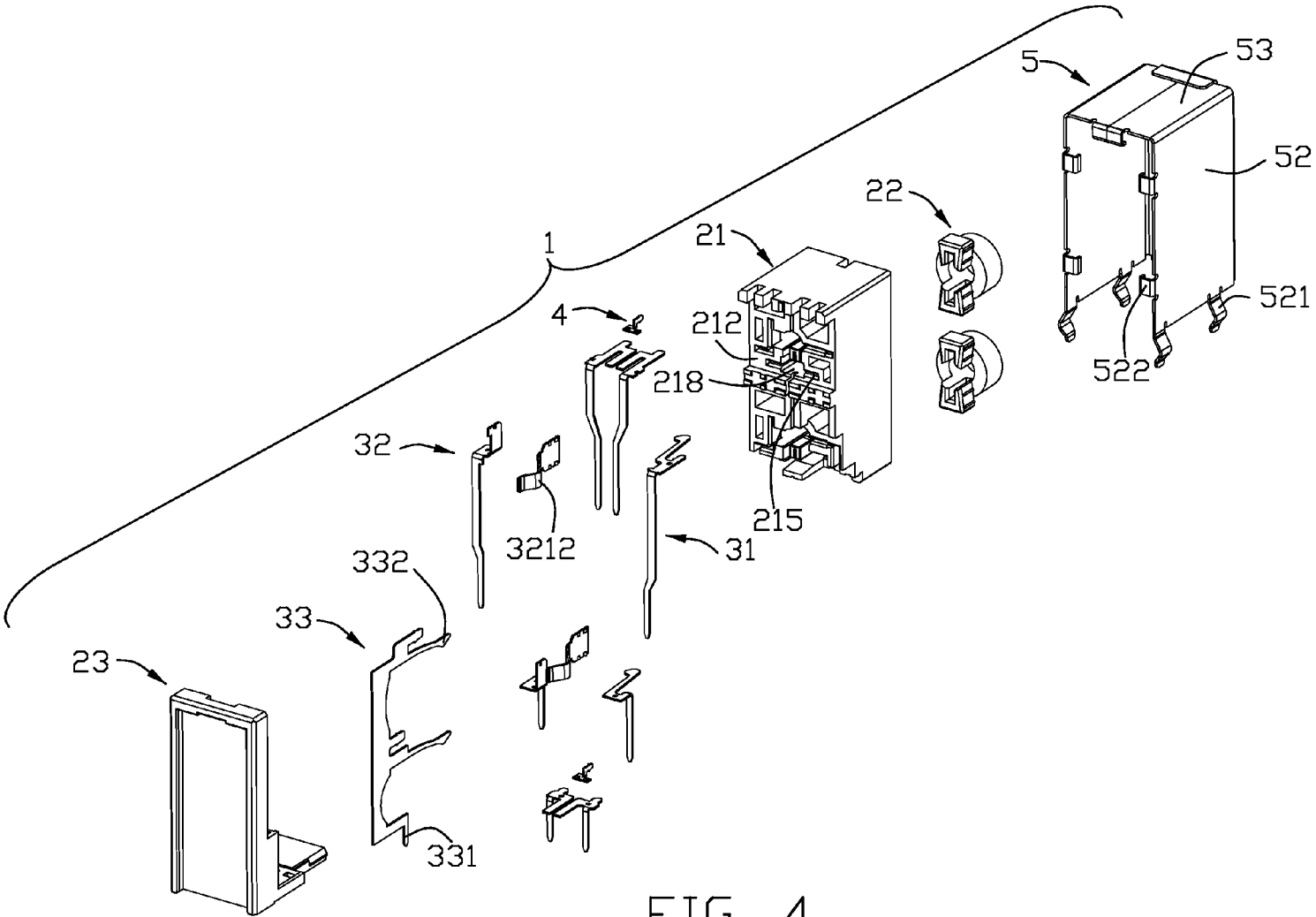
FIG. 4 is a view similar to FIG. 3, while taken from another aspect.
Figure 5:
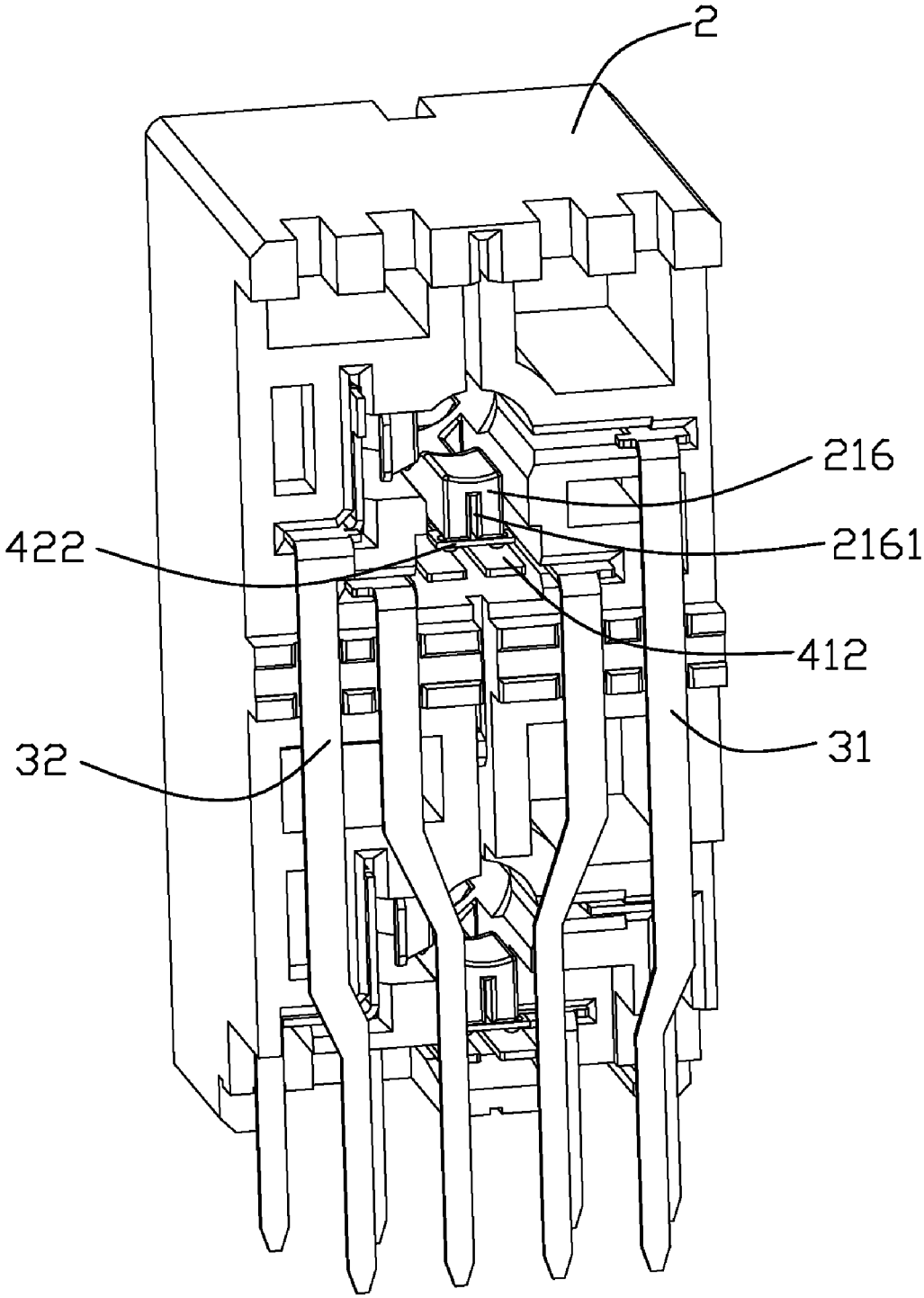
FIG. 5 is a perspective view of an insulative housing, a plurality of contacts and detection terminals of the audio jack shown in FIG. 1.
Figure 6:
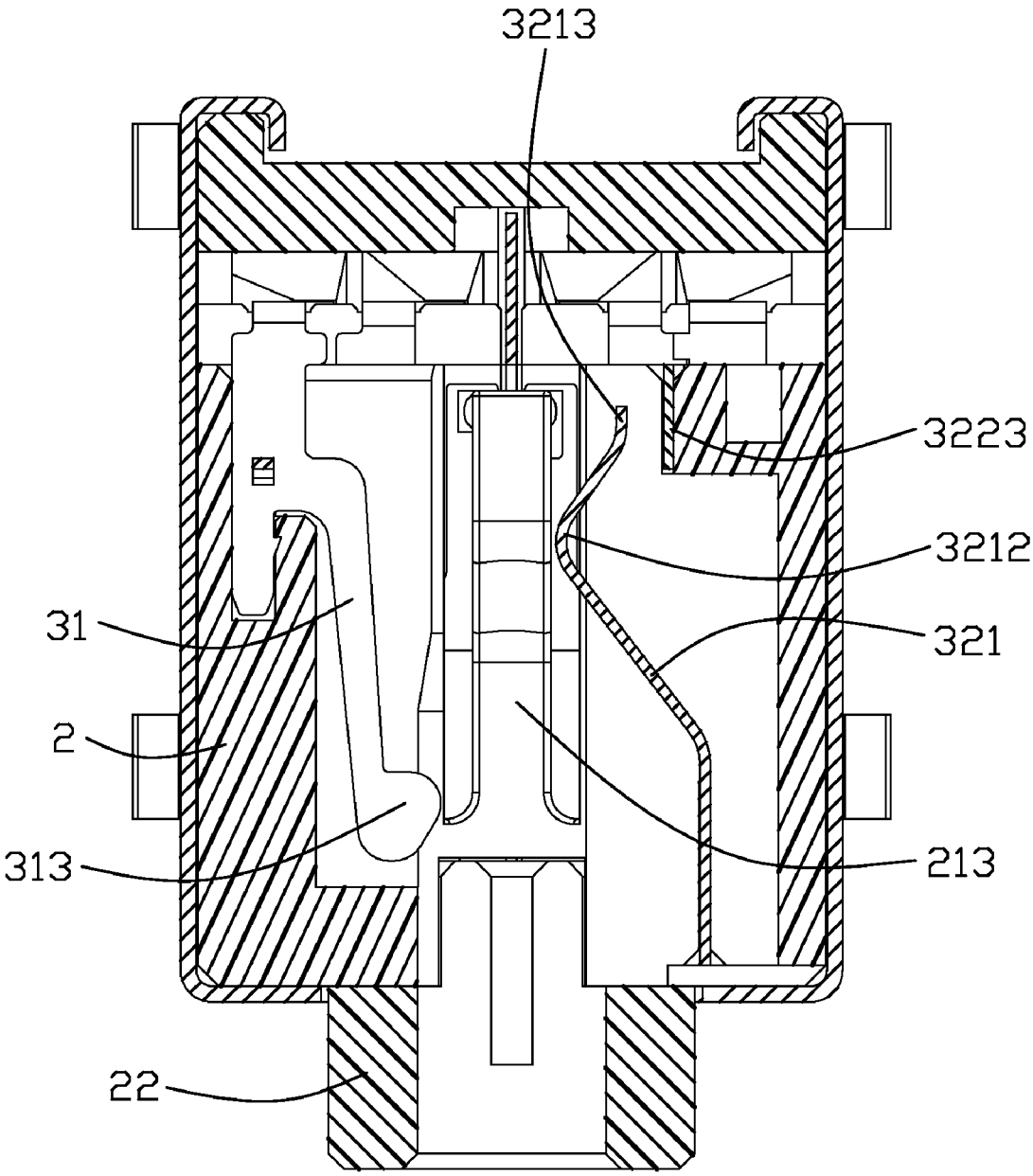
FIG. 6 is a cross-sectional view of the audio jack shown in FIG. 1.
Figure 7:
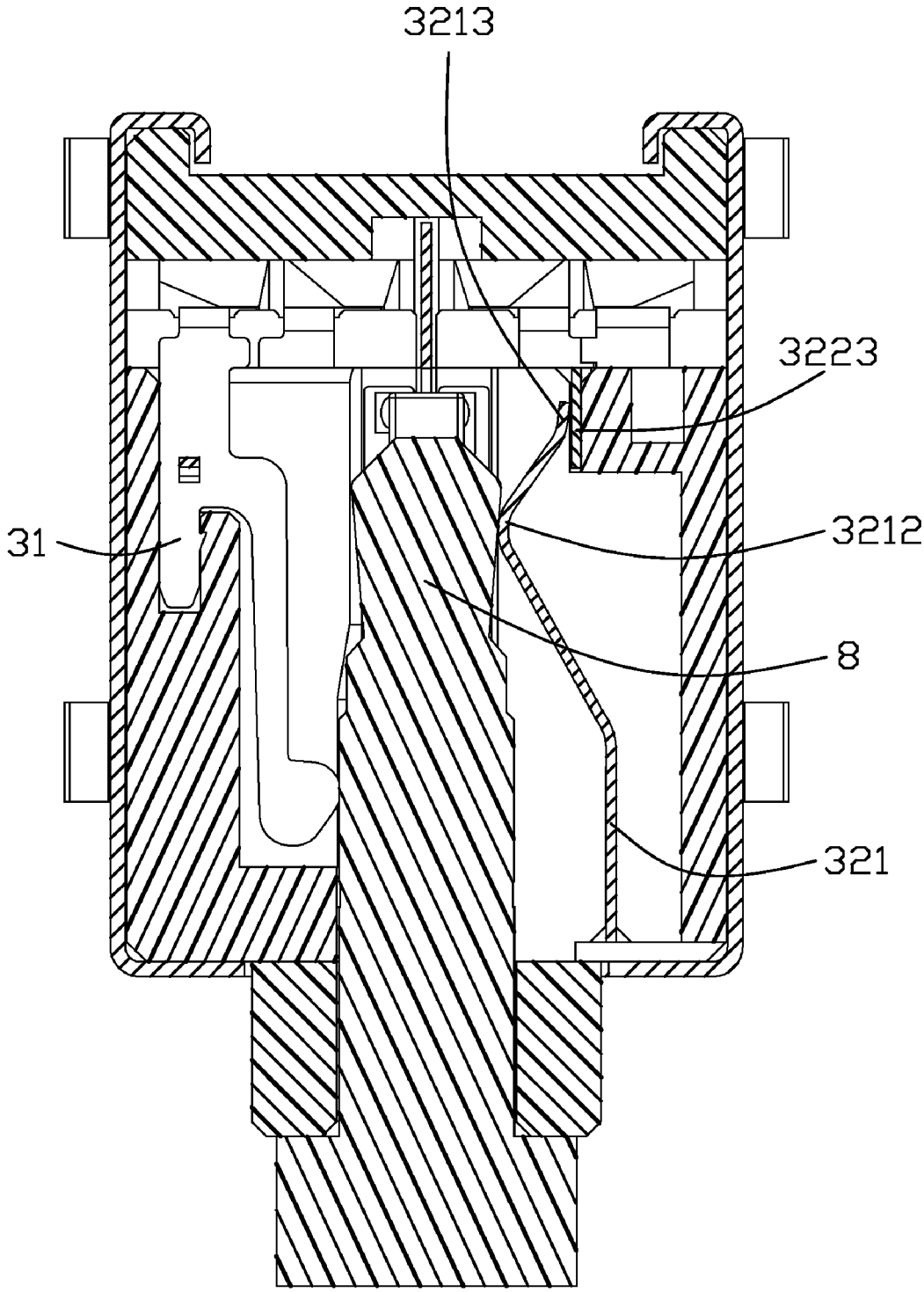
FIG. 7 is a cross-sectional view of the audio jack with a corresponding audio plug being fully inserted therein.

Referring to FIGS. 1-7, an audio jack 1 for receiving a corresponding audio plug 8 is disclosed in accordance with the present invention. The audio jack 1 comprises an insulative housing 2, a plurality of contacts 3 and two groups of detection terminals 4 retained in the insulative housing 2, and a metal shell 5 covering the insulative housing 2.

The insulative housing 2 comprises a main body 21, a pair of rings 22 attached at a front side of the main body 21 and a spacer 23 retained at a rear and lower side of the insulative housing 2 for positioning the contacts 3. The main body 21 has two same parts stacked with each other along an up to down direction, and one part of the main body 21 will be detailedly described in the following specification. The main body 21 has a front wall 211 and a rear wall 212, an insertion opening 213 extending therethrough along a front to back direction, a pair of grooves 214 at upper and lower sides of the insertion opening 213 respectively for retaining the rings 22, and a position slot 217 recessed from the front wall 211 and located at a right side of the insertion opening 213. The position slot 217 communicates with the insertion opening 213 along the front to back direction. The main body 21 defines a plurality of passageways 215 recessed from the rear wall 212 and communicating with the insertion opening 213 for retaining the contacts 3 and detection terminals 4. The main body 21 further has a cantilever 216 cantileveredly received in the insertion opening 213. The cantilever 216 can be resisted by the audio plug 8 to move along the up to down direction and defines a slit 216 extending along the up to down direction.

The rings 22 each has a circular insertion portion 221 and a pair of blocks 222 extending rearwardly from a rear side of the insertion portion 221. The blocks 222 are retained in the grooves 214 to fasten the rings 22 to a front side of the main body 21. The insertion portion 221 defines an opening 223 corresponding to the insertion opening 213 of the main body 21.

The spacer 23 defines a plurality of through holes 231 to position the contacts 3 and detection terminals 4 and a tongue 232 extending forwardly from a bottom side thereof and retained at a lower side of the main body 21.

The contacts 3 comprise two groups of contacts retained in two parts of the main body 21 respectively. The two groups of contacts are similar, and one group thereof will be detailedly described in following. Each group of contacts 3 comprise a left channel contact 31 and a right channel contact 32. The left channel contact 31 is retained in a left passageway 215 of the main body 21, and the right channel contact 32 is retained in a right passageway 215 of the main body 21. The left channel contact 31 has a tail portion 311 extending along the up to down direction, a securing portion 312 bending forwardly from the tail portion 311 and extending along a horizontal direction, and a contact portion 313 extending sidewardly and forwardly from one side of the securing portion 312. The contact portion 313 extends into the insertion opening 213 for contacting with the audio plug 8.

The right channel contact 32 comprise a mating section 321 and a transmission section 322 separated with each other along a transverse direction of the insulative housing 2. The mating section 321 does not connect with the circuit board, and has a first position portion 3211 at one end thereof, a first connection portion 3213 at another end thereof, and a contact portion 3212 extending sidewardly and rearwardly from the first position portion 3211 and located between the first position portion 3211 and the first connection portion 3213. The first position portion 3211 is retained in the position slot 217. The first connection portion 3213 extends to a rear side of the insertion opening 213 and can move sidewardly to contact with the transmission position 322. The contact portion 3212 is located at an inner side of the first position portion 3211 and first connection portion 3213 along the transverse direction of the insulative housing 2 and extends into the insertion opening 213 to contact with the audio plug 8.

The transmission portion 322 has a tail portion 3221 extending along the up to down direction, a second position portion 3222 bending forwardly and extending horizontally from the tail portion 3221, and a second connection portion 3223 bending upwardly from one side of the second position portion 3222. The second connection portion 3223 has a rear end retained in the passageways 215 and a front end extending into the insertion opening 213 and located at an outer side of the first connection portion 3213.

In an insertion process of the audio plug 8, a front end of the audio plug 8 contacts with the contact portion 3212 of the mating section 321 in an initial time, and the first connection portion 3213 of the mating section 321 does not contact with the second connection 3223 of the transmission section 322 and can not transmit audio signals to consumers; when the audio plug 8 is continually inserted into the insertion opening 213, the front end of the audio plug 8 moves inwardly and resists the contact portion 3212 to move outwardly, at this time, the contact portion 3212 drives the first connection portion 3213 moving toward the second connection portion 3223; when the audio plug 8 is fully inserted into the insertion opening 213, the first connection portion 3213 contacts with the second connection portion 3223, at this time, the mating section 321 can electrically connect with the circuit board via the tail portion 3221 of the transmission section 322 and transmit audio signals to consumers.

As described above, in the insertion process, the audio plug 8 contacts and resists the contact portion 3212 of the mating section 32, which can make the audio plug 8 contact with the contact 3 of the audio jack 1 stably; besides, before the audio plug 8 is fully inserted into the insertion opening 213, the mating section 321 does not electrically connect with the circuit board, and the audio plug 8 can not transmit audio signal to consumers when the audio plug 8 rubs the contact portion 3212 of the mating section 321, thereby, there is not any noise being transmitted to consumers.

The contacts 3 further comprise a grounding contact 33. The grounding contact 33 has a tail portion 331 for connecting with the circuit board, a pair of contact portions 332 spaced apart from each other along the up to down direction and extending into two insertion openings 213 of two parts of the insulative housing 2.

The detection terminals 4 are retained in the passageways 215 and the slits 2161 below the insertion opening 213. The detection terminals 4 comprise a pair of first contacts 41 symmetrical with each other along the transverse direction, a second contact 42 spaced apart from the first contacts 41 along the up to down direction. The first contacts 41 each has a soldering portion 411 extending along the up to down direction, a detection portion 412 bending forwardly from the soldering portion 411 and extending along the horizontal direction. The second contact 42 has a coupled portion 421 retained in the slit 2161 along the up to down direction, and a level portion 422 bending from a rear side of the coupled portion 421 parallel to the detection portions 412. The cantilever 216 and the detection portions 412 define a movable space 218 therebetween for supplying the cantilever 216 moving along the up to down direction therein. When the audio plug 8 is fully inserted into the insertion opening 213, the audio plug 8 resists the cantilever 216 moving downwardly, then the cantilever 216 drives the level portion 422 of the second contact 42 moving downwardly to contact the detection portions 412 of the first contacts 41, at this time, the level portion 422 presents as a medium to contact and connect the detection portions 412 of two detection terminals 41 with each other for transmitting an detectable signal to circuit board.

The metal shell 5 is assembled to the insulative housing 2 along the front to back direction. The metal shell 5 comprises a mating wall 51 covering the front wall 211 of the insulative housing 21, a pair of side walls 52 extending rearwardly from two sides of the mating wall 51, and a top wall 53 bending rearwardly from a top end of the mating wall 51. The mating wall 51 defines a pair of mating holes 511 corresponding to the rings 22. The side walls 52 each has a mounting leg 521 extending downwardly for positioning the audio jack 1 to the circuit board. The top wall 53 and side walls 52 each has a pair of latches 522 locking with a rear side of the insulative housing 2.

According to the present invention, the right channel contact 32 is designed to include separated two sections for postponing the signal transmission between the audio plug 8 and the circuit board, which can avoid noise being produced and transmitted to consumers when the audio plug 8 rubs the contact portion 3212 in the insertion process. Of course, the left channel contact 31 in the present invention can be designed to include two parts such as the right channel contact 32 has, which can further decrease disturb of noise. In addition, the mating section 321 of the contact 3 is assembled to the position slot 217, of course, the mating section 321 can be insert molded into the insulative housing 2 for having a better position.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An audio jack, comprising:

an insulative housing defining an insertion opening; and a plurality of contacts retained in the insulative housing, each contact having a contact portion extending into the insertion opening and a tail portion for connecting with a circuit board;

wherein at least a contact comprises a mating section for contacting with a corresponding audio plug and a transmission section separated with the mating section for connecting with the circuit board which the mating section does not connect, at least a contact portion is arranged on the mating section to electrically connect with the transmission section when the audio plug is fully inserted into the insertion opening;

wherein the insulative housing has a front wall for mating with the audio plug, a rear wall opposite to the front wall, a position slot recessed from the front wall, a plurality of passageways recessed from the rear wall, the position slot, passageways and insertion opening communicate with each other; wherein the mating section has a first position portion at one end thereof and a first connection portion at another end thereof, the first position portion is retained in the portion slot, and the first connection portion extends into the insertion opening from the first position portion and can moves sidewardly to contact with the transmission section, the contact portion is located between the first connection portion and the first position portion and arranged at an inner side of the first position portion and the first connection portion along a transverse direction; wherein the transmission section has a second position portion retained in the passageways, a second connection portion extending from the second position portion to contact with the first connection portion, at least a said tail portion extending from the second position portion; wherein the second position portion extends along a horizontal direction of the insulative housing, the tail portion extends downwardly from a rear end of the second position portion, and the second connection portion extends upwardly from one side of the second position portion.

2. The audio jack according to claim 1, wherein the second connection portion has a rear end retained in the passageways and a front end extending into the insertion opening and located at an outer side of the first connection portion along the transverse direction.

3. The audio jack according to claim 1, further comprising a group of detect terminals, the detect terminals comprise a pair of first terminals symmetrical with each other along a transverse direction of the insulative housing and a second terminal spaced apart from the first terminals along an up to down direction, the second terminal can move along the up to down direction to contact and connect the first terminals together.

4. The audio jack according to claim 3, wherein the first terminals each has a detection portion extending along the horizontal direction and a soldering portion extending downwardly from the detection portion, and the second terminal has a coupled portion retained in the insulative housing and a level portion parallel to the detection portions.

5. The audio jack according to claim 4, wherein the insulative housing has a cantilever cantileveredly received in the insertion opening, the cantilever defines a slit to retain the coupled portion, the cantilever can drive the second terminal moving downwardly to contact with the detection portions of two first terminals when the audio plug is fully inserted into the insertion opening.

6. The audio jack according to claim 1, wherein the insulative housing defines two said insertion openings stacked with each other along an up to down direction, the contacts further comprises a grounding contact, the grounding contact has a said tail portion extending along an up to down direction and a pair of said contact portions extending into the insertion openings respectively.

7. The audio jack according to claim 1, wherein the insulative housing comprises a spacer retained at a rear and lower side thereof, the spacer defines a plurality of through holes extending therethrough along an up to down direction to position the tail portions.

8. A contact attached to an audio jack, comprising:

a mating section having a first position portion retained in the audio jack, a contact portion extending from the first position for contacting with an audio plug, and a first connection portion connecting with the contact portion; and a transmission section having a second position portion attached to the audio jack, a second connection portion extending from the second position portion and a soldering portion extending downwardly from the second position portion for connecting with a circuit board;

wherein the mating section is separated from the transmission section, and the mating section can electrically connect with the circuit board via the first connection portion contacts with the second connection when the audio plug is fully inserted into the audio jack;

wherein the second position portion extends along a horizontal direction, the second connection portion extends upwardly from one side of the second position portion; wherein the mating section extends along a front to back direction, the first connection portion is parallel to the second connection portion and located at an inner side of the second connection portion.

9. The contact according to claim 8, wherein the first position portion is retained at a front side of the audio jack, the contact portion extends rearwardly from the first position portion, and the first connection portion is arranged at a free end of the contact portion.

10. An electrical connector for use with a plug, comprising:

an insulative main body defining an insertion opening;

a conductive contact located by one side of the insertion opening and including:

a mating section and a transmission section being discrete from each other under condition that said mating section is located closer to the insertion opening than the transmission section;

said mating section including a first retention section to retain the mating section in the housing, a curved contact section extending from the first retention section into the insertion opening, and a first connection section extending from the contact section at a free end of the contact section;

said transmission section including a second connection section essentially aligned with said first connection section in a radial direction, a tail section extending downwardly for mounting to a printed circuit board on which said main body is seated, and a second retention section located between the second connection section and the tail section to retain the transmission section to the housing; wherein when the plug is inserted into the insertion opening to outwardly deflect the mating section, said mating section experiences initially deflection of a cantilevered type before the first connection section contacts the second connection section while successively that of a simple support type after the first connection section contacts the second connection section due to support of the housing behind the second connection section.

11. The electrical connector as claimed in claim 10, wherein said first retention section essentially extends in a first plane while said second retention section essentially extends in a second plane perpendicular to said first plane.

12. The electrical connector as claimed in claim 11, wherein both said first plane and said second plane extends along an insertion direction of the plug which is perpendicular to said radial direction.

13. The electrical connector as claimed in claim 12 wherein a thickness direction of the tail section of said transmission section is essentially along said insertion direction of the plug.

14. The electrical connector as claimed in claim 11, wherein said first connection section defines a third plane and said second connection section defines a fourth plane both of which are parallel to said first plane.

* * * * *